US007917996B2

(12) United States Patent
Ohashi

(10) Patent No.: US 7,917,996 B2
(45) Date of Patent: Apr. 5, 2011

(54) OPENING-AND-CLOSING MECHANISM

(75) Inventor: Naoki Ohashi, Shizuoka (JP)

(73) Assignee: Beckman Coulter, Inc., Brea, CA (US)

( * ) Notice: Subject to any disclaimer, the term of this patent is extended or adjusted under 35 U.S.C. 154(b) by 354 days.

(21) Appl. No.: 11/997,492

(22) PCT Filed: Aug. 3, 2006

(86) PCT No.: PCT/JP2006/315401

§ 371 (c)(1),
(2), (4) Date: Aug. 6, 2008

(87) PCT Pub. No.: WO2007/015543

PCT Pub. Date: Feb. 8, 2007

(65) Prior Publication Data

US 2010/0095485 A1 Apr. 22, 2010

(30) Foreign Application Priority Data

Aug. 4, 2005 (JP) ..... 2005-226931

(51) Int. Cl.
*E05D 11/10* (2006.01)

(52) U.S. Cl. ..... 16/334; 16/280; 16/289; 16/319; 16/342; 16/374

(58) Field of Classification Search ..... 16/334, 16/330, 307, 54, 50, 319, 299–301, 289, 16/280; 4/236, 237, 243, 242.1; 188/306, 188/307, 300, 297
See application file for complete search history.

(56) References Cited

U.S. PATENT DOCUMENTS

| | | | | |
|---|---|---|---|---|
| 5,996,132 | A * | 12/1999 | Sorimachi | 4/236 |
| 6,665,906 | B2 * | 12/2003 | Li | 16/330 |
| 2004/0211211 | A1 * | 10/2004 | Nam et al. | 62/440 |
| 2005/0091794 | A1 * | 5/2005 | Kang | 16/284 |
| 2005/0108853 | A1 * | 5/2005 | Lee | 16/330 |
| 2005/0193523 | A1 * | 9/2005 | Nam et al. | 16/330 |
| 2006/0162125 | A1 * | 7/2006 | Anzai | 16/303 |

FOREIGN PATENT DOCUMENTS

| | | |
|---|---|---|
| JP | HEI-6-81876 | 3/1994 |
| JP | 06-229417 | 8/1994 |
| JP | 2004-143745 | 5/2004 |

* cited by examiner

*Primary Examiner* — Chuck Y. Mah
(74) *Attorney, Agent, or Firm* — Kilpatrick Townsend & Stockton LLP

(57) ABSTRACT

The present invention provides an opening-and-closing mechanism capable of reducing a falling momentum due to gravitational force of a lid that is opened and closed past the top in the perpendicular direction and easily raising the lid against the gravitational force. The opening-and-closing mechanism includes two supporting members (7, 9) and an intermediate member (15) disposed so as to be relatively rotatable about a rotation axis; a first damper (11R), disposed between a first one of the supporting members (9) and the intermediate member (15), for generating resistance against rotation during relative rotation of the two supporting members (7, 9) in one direction; a second damper (11L), disposed between a second one of the supporting members (7) and the intermediate member (15), for generating resistance against rotation during relative rotation of the two supporting members (7, 9) in another direction; and rotation-restricting portions (29R, 29L) for restricting relative rotation ranges of the two supporting members (7, 9) and the intermediate member (15).

5 Claims, 6 Drawing Sheets

OPENING-AND-CLOSING MECHANISM

CROSS-REFERENCES TO RELATED APPLICATION

This application is a U.S. National Phase Application under 35 U.S.C. §371 of International Application No. PCT/JP2006/315401 filed Aug. 3, 2006, which claims the benefit of priority from Japanese Patent Application No. 2005-226931, filed Aug. 4, 2005, the entire content of all of which are incorporated herein by reference.

TECHNICAL FIELD

The present invention relates to an opening-and-closing mechanism.

BACKGROUND ART

In general, rotating lids used for opening and closing pianos, laptop computers, and office equipment such as copy machines, and opening-and-closing lids of refrigerated compartments for reagents, analysis equipment, such as DNA sequencers, and antibody detection devices, are provided such that one end of the lid is supported by a rotary shaft, and the other end is rotatable in the vertical direction.

However, when the above described lid etc. is to be closed, the momentum of the closing lid tends to increase because the weight of the lid itself acts in the closing direction. When the momentum of the closing lid etc. is large, the lid or the main body may be damaged due to the impact when lid closes. In particular, a heavy lid tends to slam shut, causing damage to the lid and so on.

Therefore, to prevent such damage, various techniques for reducing the momentum of closing the lids etc. have been proposed (for example, see Patent Document 1).

Patent Document 1

Patent Document 1: Japanese Unexamined Patent Application, Publication No. HEI-6-81876 (page 2, FIG. 7, etc.)

DISCLOSURE OF INVENTION

Patent Document 1 described above discloses a rotary damper having a structure in which oil is filled in a gap between a piston and a body case to reduce a rotary torque using viscous drag of the oil filled therebetween. A male threaded portion and a female threaded portion are formed at the piston, and the body case is configured in such a manner that the piston moves forward and backward while rotating relative to the body case. Accordingly, with the rotary damper having the structure described above, it is possible to generate resistance against rotary motion of the piston in one rotation direction.

However, the rotary damper in Patent Document 1 described above generates resistance against a rotary motion only in one direction.

Accordingly, there is a problem in that the rotary damper described above cannot generate resistance against a rotary motion (opening rotary motion) of the lid falling down due to gravitational force when the rotary damper is disposed in such a manner as to be capable of generating resistance in the rotation direction in which the lid etc. is closed, and when the lid etc. is widely opened past the top in the perpendicular direction.

In other words, when the lid etc. is opened so that the center of gravity goes past a plane extending perpendicularly from the rotation center, the rotation direction of the lid etc. when falling due to gravity is reversed from rotation in the closing direction of the lid to rotation in the opening direction. Accordingly, there is a problem in that, with a rotary damper that generates resistance against the rotary motion only in one rotation direction, even though it is possible to generate resistance against rotary motion of the lid in one direction (closing rotational movement) when falling due to gravitational force, it is not possible to generate resistance against the rotary motion of the lid in the other direction (opening rotational movement) when falling due to gravitational force.

The present invention has been conceived to solve the above-described problems, and an object thereof is to provide, in a lid that is opened and closed past the top in the perpendicular direction, an opening-and-closing mechanism capable of reducing a falling momentum due to gravitational force of the lid etc., while allowing the lid etc. to be easily raised against the gravitational force.

In order to realize the above object, the present invention provides the following solutions.

The present invention provides an opening-and-closing mechanism comprising two supporting members and an intermediate member disposed so as to be relatively rotatable about a rotation axis; a first damper, disposed between a first one of the supporting members and the intermediate member, for generating resistance against rotation during relative rotation of the two supporting members in one direction; a second damper, disposed between a second one of the supporting members and the intermediate member, for generating resistance against rotation during relative rotation of the two supporting members in another direction; and rotation-restricting portions for restricting relative rotation ranges of the two supporting members and the intermediate member.

According to the present invention, when the two supporting members relatively rotate about the rotation axis in one direction, the first damper, which generates resistance when rotating relatively in that direction, restricts the relative rotation of the intermediate member relative to the first one of the supporting members. Accordingly, the first one of the supporting members and the intermediate member rotate together relative to the second one of the supporting members.

On the other hand, because the second damper, disposed between the second supporting member and the intermediate member, does not generate resistance when relatively rotating in that direction, the second supporting member and the intermediate member relatively rotate within the relative rotation range restricted by the rotation-restricting portion. At this time, because the first damper and the second damper do not generate resistance, the two supporting members can be relatively rotated by a comparatively small force.

Thereafter, when the relative rotation between the second supporting member and the intermediate member is restricted by the rotation-restricting portion, the force for relatively rotating the two supporting members is transmitted to the intermediate member, and the intermediate member and the first supporting member relatively rotate against the resistance of the first damper within the relative rotation range restricted by the rotation-restricting portion. Although the second damper does not generate resistance at this time, the two supporting members relatively rotate when a large force corresponding to the amount of resistance of the first damper is applied thereto.

On the other hand, when the two supporting members relatively rotate about the rotation axis in the opposite direction from that state, the second damper, which generates resistance when rotating relatively in that direction, restricts the relative rotation of the intermediate member relative to the second supporting member. Accordingly, the second supporting member and the intermediate member rotate together relative to the first supporting member. On the other hand, because the first damper does not generate resistance when relatively rotating in that direction, the first supporting member and the intermediate member rotate within the relative rotation range restricted by the rotation-restricting portion. At this time, because the first damper and the second damper do not generate resistance, the two supporting members can be relatively rotated by a comparatively small force.

Thereafter, when relative rotation between the first supporting member and the intermediate member is restricted by the rotation-restricting portion, the force for relatively rotating the two supporting members is transmitted to the intermediate member, and the intermediate member and the second supporting member relatively rotate against the resistance of the second damper within the relative rotation range restricted by the rotation-restricting portion. Although the first damper does not generate resistance at this time, the two supporting members relatively rotate when a large force corresponding to the amount of resistance of the second damper is applied thereto.

As a result, when rotating relatively toward a predetermined position disposed at an intermediate position within the range of relative rotation of the two supporting members, it, is possible to relatively rotate with a small force, and when relatively rotating away from the predetermined position, it is possible to prevent relative rotation so long as a force exceeding the resistance of one of the damper is not applied.

In the invention described above, at a relative rotation position of the two supporting members where operating states of the two dampers are changed, the relative rotation ranges of the rotation-restricting portions are preferably set so that a center of gravity of a rotary member fixed to the first one of the supporting members is disposed within a perpendicular plane including the rotation axis.

In this way, the operating states of the two dampers are changed when the center of gravity of the rotary member is positioned within a perpendicular plane including the rotation axis. Accordingly, when the first supporting member and the rotary member rotate in the direction in which gravity acts, the resistance due to the first damper or the second damper is always generated, allowing a reduction of the rotational speed.

On the other hand, when the first supporting member and the rotary member are raised against the gravitational force, the first damper or the second damper does not generate the resistance.

In the invention described above, the opening-and-closing mechanism preferably further includes a stopper portion for restricting the relative rotation of the two supporting members within a predetermined range.

In this way, because the relative rotation between the first supporting member and the second supporting member is restricted in the predetermined range using the stopper portion, it is possible to prevent damage to the first damper and the second damper. In other words, by restricting the range of relative rotation of the first supporting member and the second supporting member to the usable ranges of the first damper and the second damper, it is possible to prevent damage to the first damper and the second damper when using them outside the usable range.

In the invention described above, the first damper and the second damper are preferably disposed in line on the rotation axis.

In this way, by aligning the first damper and the second damper on the rotation axis, it is possible to reduce the size of the opening-and-closing mechanism.

In the configuration described above, a plurality of dampers including at least one of the first damper and the second damper are preferably coupled in series.

In this way, because a plurality of the dampers are coupled in series, the operating ranges of each of the dampers are combined, thus allowing the overall operating range of the plurality of the dampers to be increased.

In the configuration described above, the opening-and-closing mechanism preferably further includes a restricting members for restricting movement of the first damper and the second damper in the direction of the rotation axis.

In this way, the movement of the first damper and the second damper in the direction of the rotation axis is restricted by the restricting member. In other words, because the loads in the direction of the rotation axis to be applied to the first damper and the second damper are supported by the restricting member, it is possible to prevent damage to the first damper and the second damper caused by the loads in the direction of the rotation axis.

With the opening-and-closing mechanism according to the present invention, by providing the restricting portions, the first damper can generate resistance only when the first supporting member and the second supporting member are in a predetermined positional relationship, for example, only when rotating in one direction from the top in the perpendicular direction, and the second damper can generate resistance only when rotating in the other direction from the top in the perpendicular direction. Accordingly, an advantage is afforded in that it is possible to reduce the falling momentum due to the gravitational force of the lid etc. fixed to the first supporting member and the second supporting member, and the lid etc. can be easily raised against the gravitational force.

BEST MODE FOR CARRYING OUT THE INVENTION

An opening-and-closing mechanism of a container according to an embodiment of the present invention will be described with reference to FIGS. 1 to 8.

Figure 1:
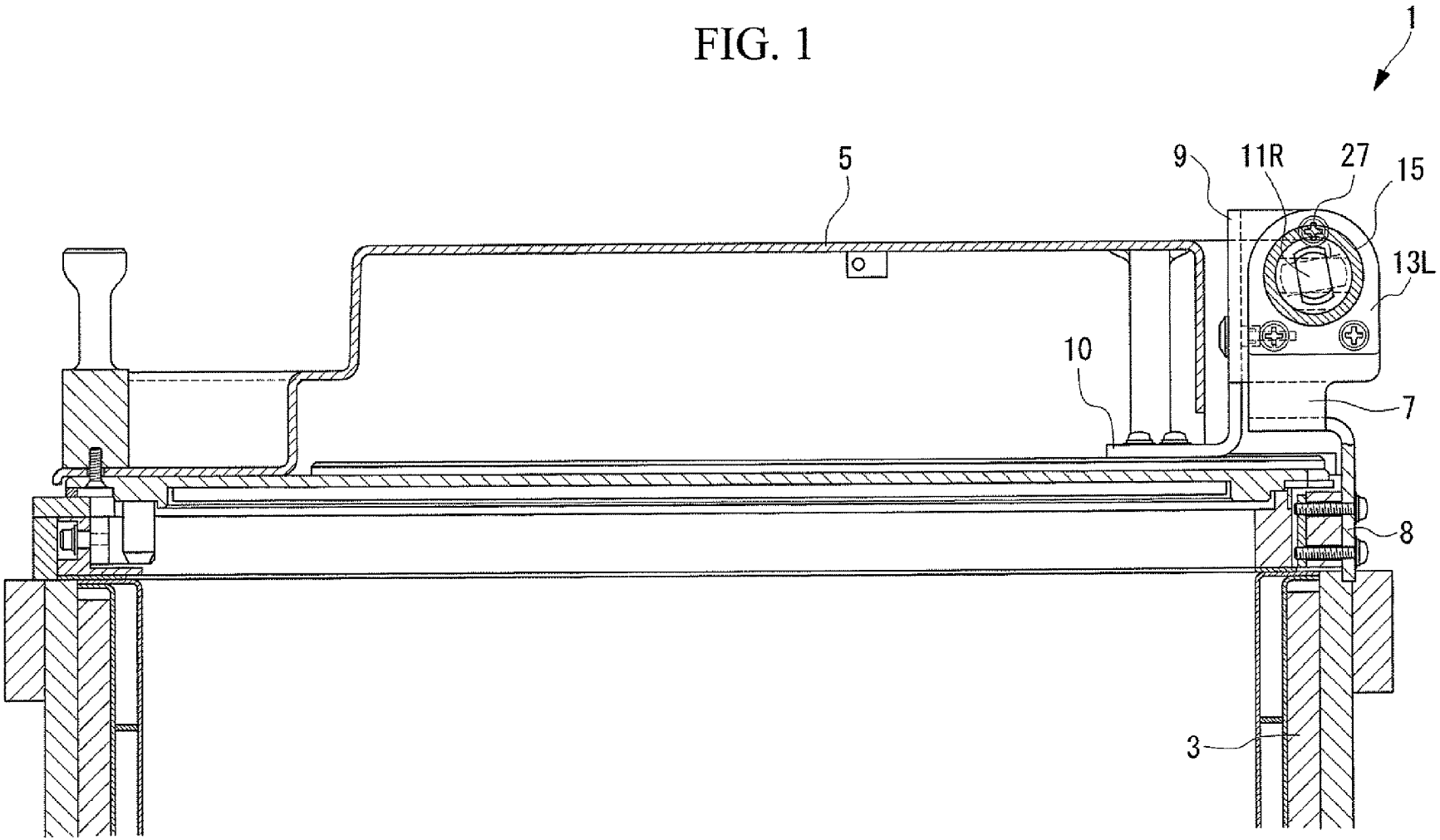
FIG. 1 is a schematic diagram showing a container having an opening-and-closing mechanism according to an embodiment of the present invention.

FIG. 1 is a schematic diagram showing the container having the opening-and-closing mechanism according to an embodiment of the present invention.

As shown FIG. 1, the opening-and-closing mechanism 1 is disposed between the container 3 of a refrigerated compartment for storing a reagent or the like and a lid (rotary member) 5 covering an opening provided at the upper end of the container 3 to support the lid 5 in such a manner that it can be opened and closed.

The container 3 is not particularly limited; it may be the container of a refrigerated compartment for storing a reagent or the like, as described above, or it may be a container of analysis equipment, such as a DNA sequencer, an antibody detection device, and so forth.

Figure 2:
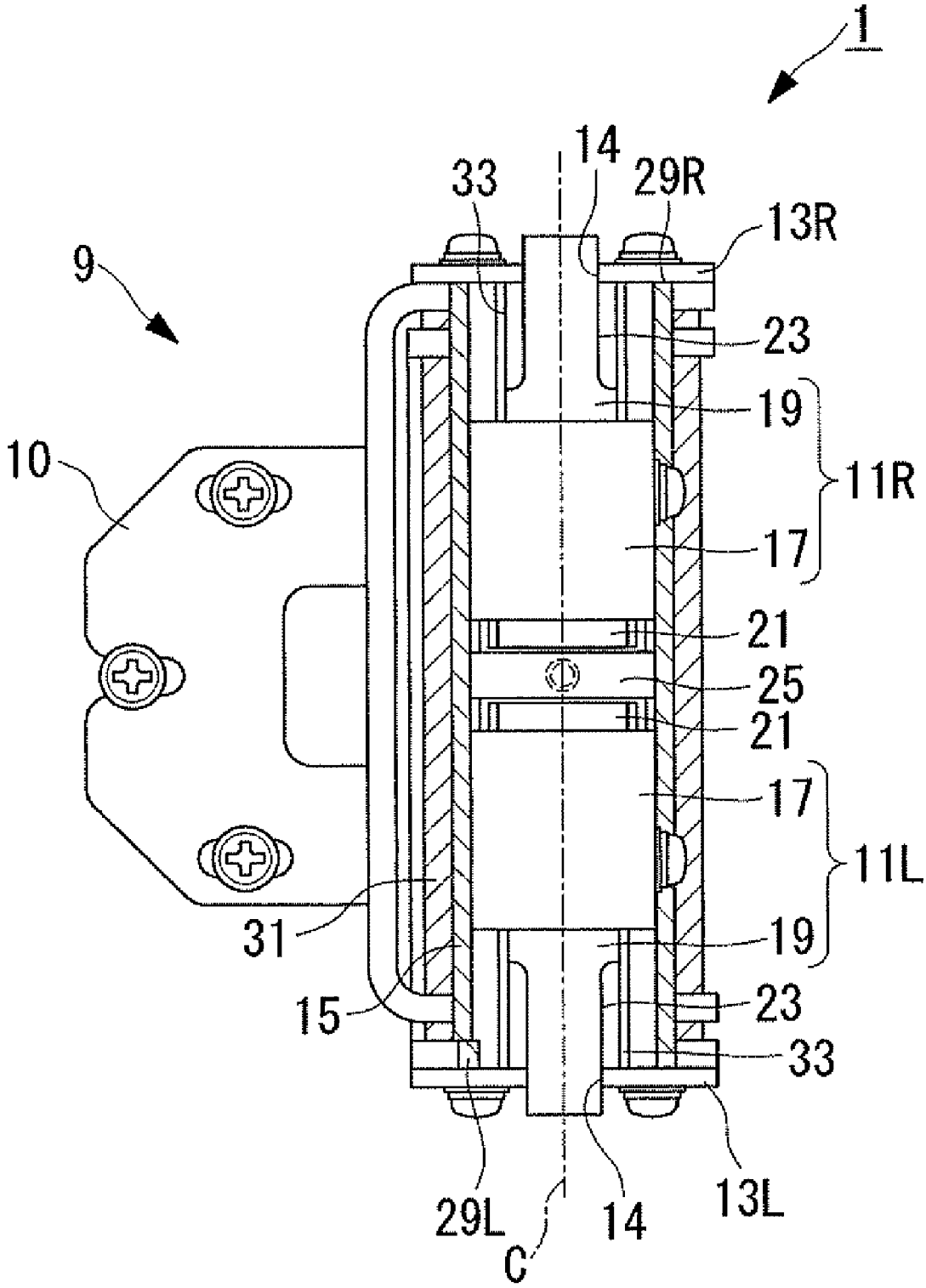
FIG. 2 is a diagram for explaining, in outline, the overall configuration of the opening-and-closing mechanism in FIG. 1.

FIG. 2 is a diagram for explaining, in outline, the overall configuration of the opening-and-closing mechanism in FIG. 1.

As shown in FIGS. 1 and 2, the opening-and-closing mechanism 1 is mainly formed of a container hinge 7 that is fixed to the container 3; a lid hinge 9 that supports the lid 5 and rotates about the rotation axis C relative to the container hinge 7; a damper (first damper) 11R and a damper (second damper) 11L that generate a predetermined resistance against the rotation of the lid hinge 9; and plate members 13R and 13L and a shaft member (intermediate member) 15 that restrict an operating range of the dampers 11R and 11L.

The container hinge 7 is fixed to the container 3 at a securing portion 8 by screws. The lid hinge 9 is fixed to the lid 5 at a securing portion 10 by screws.

The dampers 11R and 11L are mainly formed of cases 17 and a shaft 19. Case restricting portions 21 for restricting the rotation of the cases 17 are provided at the ends of the cases 17, and shaft restricting portions 23 for restricting the rotation of the shaft 19 are provided at the ends of the shaft 19. The dampers 11R and 11L generate a predetermined resistance against the relative rotation of the shaft 19 and the cases 17 in one direction and generate almost no resistance against the relative rotation in the other direction.

The damper 11R and the damper 11L are arranged in series on the rotation axis C so that the cases 17 oppose each other. A joint 25 mating with the case restricting portions 21 is disposed between the damper 11R and the damper 11L. The relative rotation of the cases 17 of the damper 11R and the damper 11L are restricted by the joint 25.

The plate member 13R is fixed to the lid hinge 9 by screws, and the plate member 13L is fixed to the container hinge 7 by screws. Fitting portions 14 for fitting the shaft restricting portions 23 of the dampers 11R and 11L therein are formed at the plate members 13R and 13L. Flat surfaces fitted in a pair of substantially parallel flat surfaces formed on the shaft restricting portions 23 are formed at the fitting portions 14.

Stopper screws (rotation-restricting portions, stopper portions) 27 for restricting, together with stopper portions of the shaft member 15 described below, the operating ranges of the dampers 11R and 11L are fixed to the plate members 13R and 13L (see FIG. 1).

Figure 3:
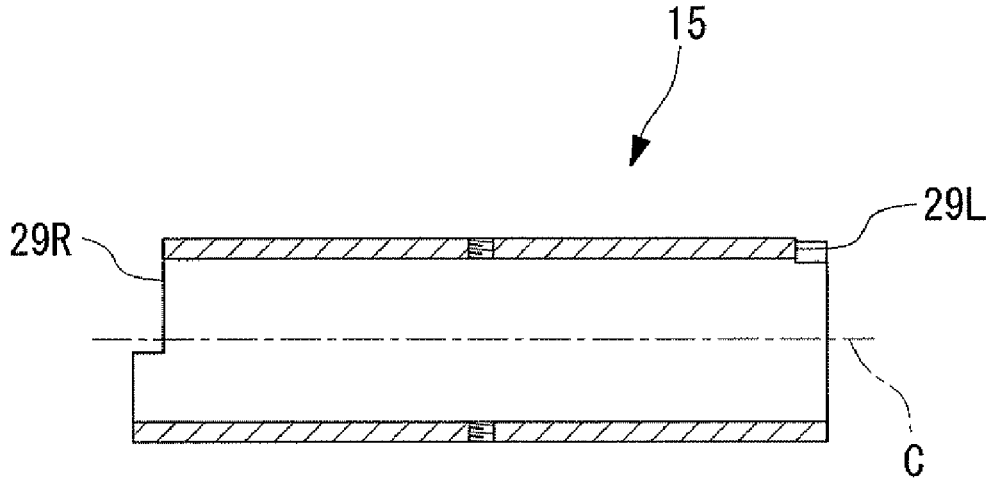
FIG. 3 is a sectional view for explaining the configuration of a shaft member in the opening-and-closing mechanism in FIG. 2.
Figure 4:
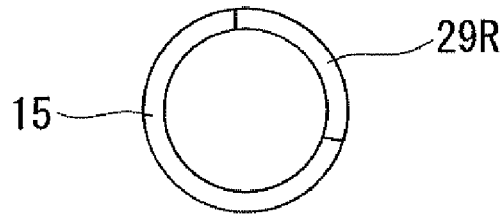
FIG. 4 is a side view for explaining the configuration of one end of the shaft member in FIG. 3.
Figure 5:
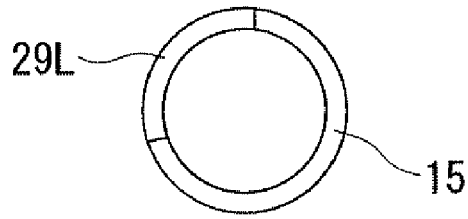
FIG. 5 is a side view for explaining the configuration of the other end of the shaft member in FIG. 3.
Figure 6A:
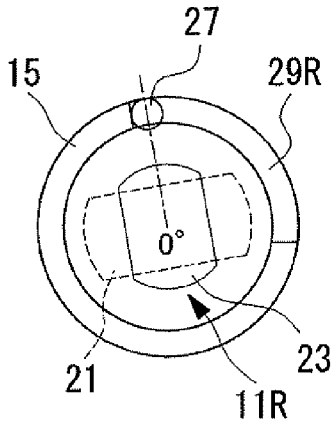
FIGS. 6(*a*), (*b*), (*c*), (*d*), (*e*), (*f*), (*g*), (*h*), and (*i*) are diagrams for explaining the movement of a damper in FIG. 2.
Figure 6B:
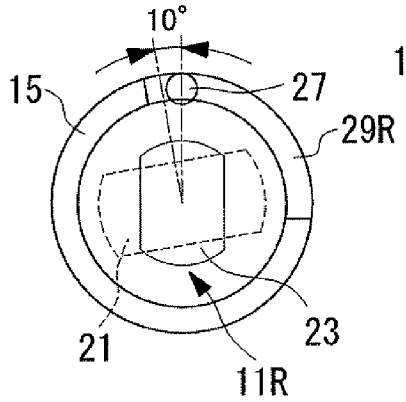
Figure 6C:
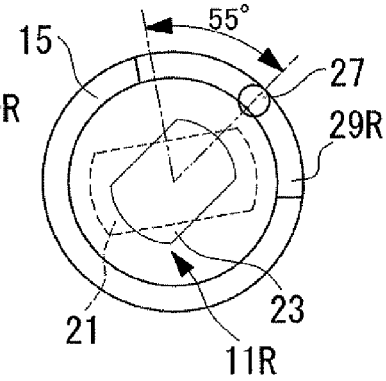
Figure 6D:
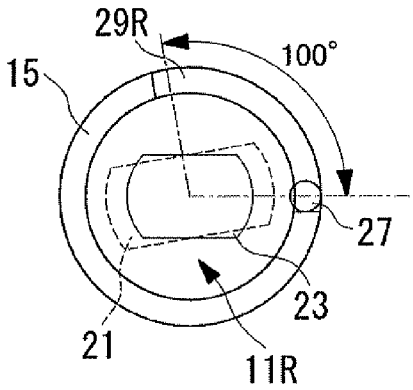
Figure 6E:
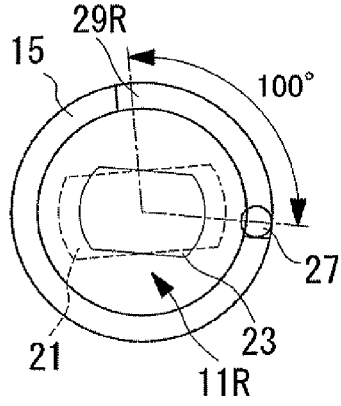
Figure 6F:
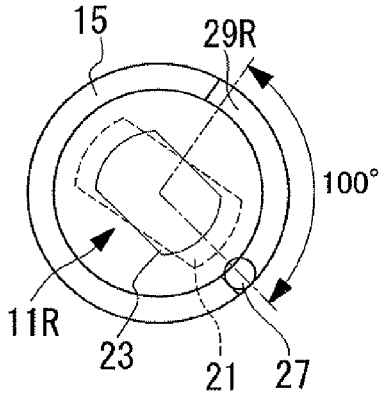
Figure 6G:
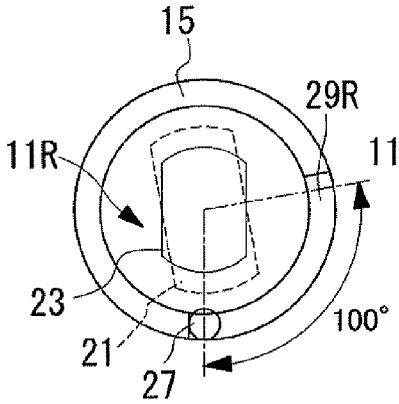
Figure 6H:
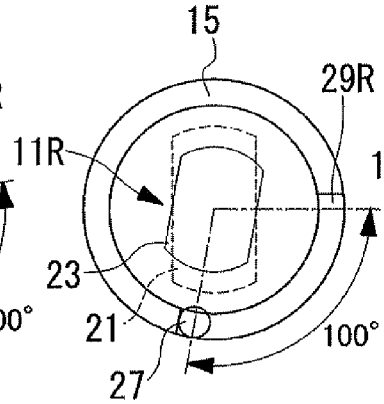
Figure 6I:
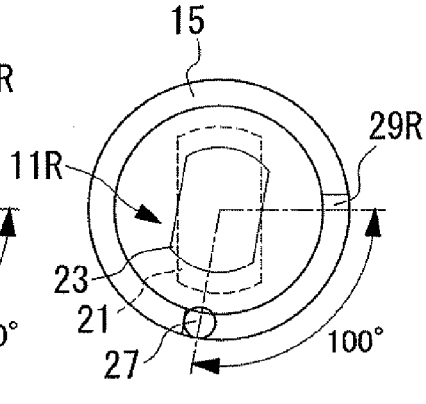
Figure 7A:
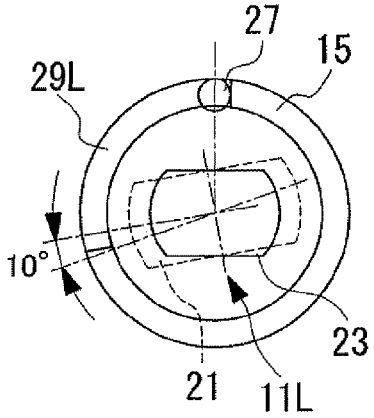
FIGS. 7 (*a*), (*b*), (*c*), (*d*), (*e*), (*f*), (*g*), (*h*), and (*i*) are diagrams for explaining the movement of the damper in FIG. 2.
Figure 7B:
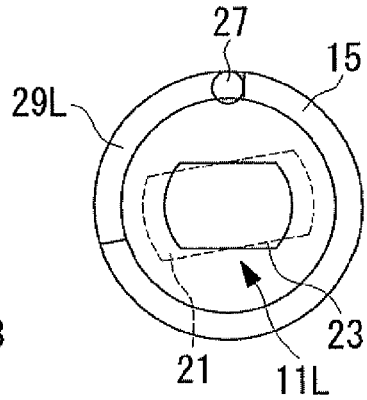
Figure 7C:
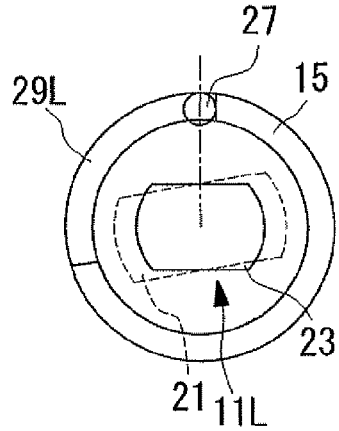
Figure 7D:
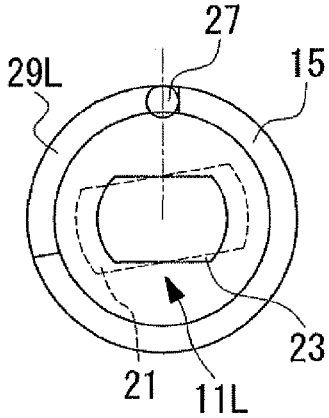
Figure 7E:
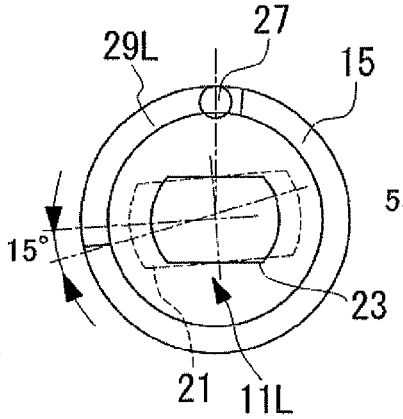
Figure 7F:
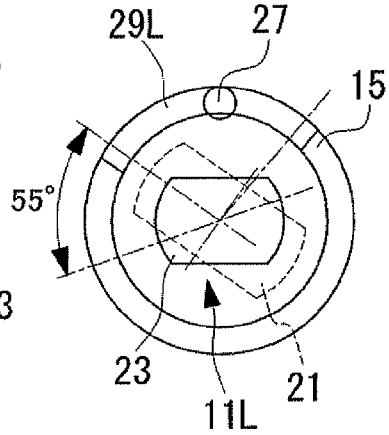
Figure 7G:
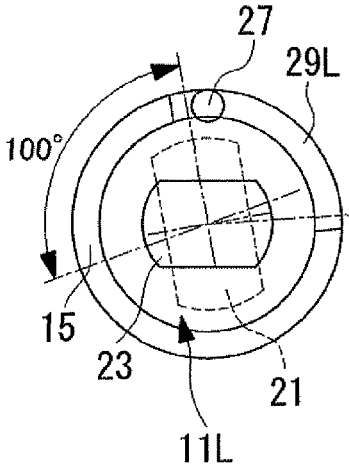
Figure 7H:
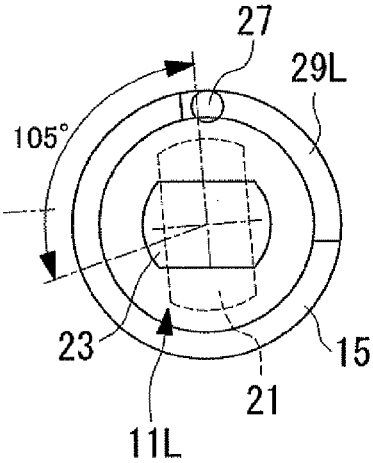
Figure 7I:
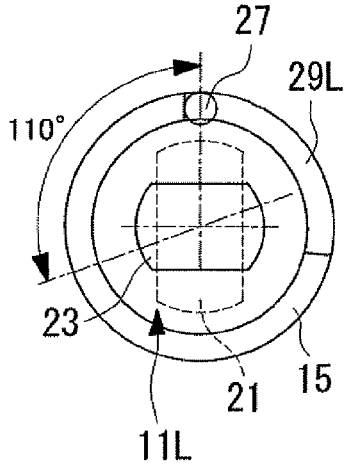

FIG. 3 is a sectional view for explaining the configuration of the shaft member in the opening-and-closing mechanism in FIG. 2. FIG. 4 is a side view for explaining the configuration of one end of the shaft member in FIG. 3. FIG. 5 is a side view for explaining the configuration of the other end of the shaft member in FIG. 3.

As shown in FIGS. 3 to 5, the shaft member 15 is formed of a member formed in a cylindrical shape and is formed in such a manner that it is possible to dispose the dampers 11R and 11L therein. The shaft member 15 and the cases 17 of the dampers 11R and 11L are secured and are disposed so that their relative phase does not change.

The stopper portions (rotation-restricting portions) 29R and 29L for restricting, together with the stopper screws 27 of the plate members 13R and 13L described above, the operating ranges of the dampers 11R and 11L are formed at end faces of the shaft member 15.

The stopper portions 29R and 29L are step portions formed in a predetermined region of the end faces of the shaft member 15.

In FIG. 4, the stopper portion 29R is formed as a step where a predetermined region is depressed, the region being from the top in a direction substantially perpendicular to the rotation axis C to the side where the lid 5 is not disposed (right side). More specifically, the stopper portion 29R is formed in a range from the position substantially 10° leftward from the top in a direction perpendicular to the rotation axis C, to the position substantially 90° rightward.

In FIG. 5, the stopper portion 29L is formed as a step where a predetermined region is depressed, the region being from the top in a direction perpendicular to the rotation axis C to the side where the lid 5 is disposed (left side). More specifically, the stopper portion 29L is formed in a range from a position at the top in a direction perpendicular to the rotation axis C, to a position substantially 100° leftward.

As shown in FIG. 2, a collar 31 also having a substantially cylindrical shape is disposed around the shaft member 15. A substantially cylindrical bush (restricting member) 33 is disposed around the shaft 19 of the dampers 11R and 11L. The bush 33 prevents the dampers 11R and 11L from moving in the rotation axis C direction by contacting with the cases 17 and either the plate member 13R or the plate member 13L.

Next, the operation of the opening-and-closing mechanism 1 having the above configuration will be described.

The operating range of the opening-and-closing mechanism 1 is from where the opening of the container 3 of the lid 5 is in a closed state (0°) to where the lid 5 is in a substantially horizontal state (180°), passing the top in the perpendicular direction (90°) (see FIG. 1). The opening-and-closing mechanism 1 rotatably supports the lid 5 within this range.

The movement of the dampers 11R and 11L when the lid 5 is opened will be described. First, the movement of the damper 11R will be described.

As shown in FIG. 2, when the lid 5 starts opening, the plate member 13R starts rotating about the rotation axis C together with the lid hinge 9. The rotation of the plate member 13R is transmitted to the shaft 19 of the damper 11R via the fitting portion 14 and the shaft restricting portion 23.

FIGS. 6(*a*), (*b*), (*c*), (*d*), (*e*), (*f*), (*g*), (*h*), and (*i*) are diagrams for explaining the movement of the damper 11R in FIG. 2.

As shown in FIGS. 6(*b*), (*c*), and (*d*), the stopper screw 27 of the plate member 13R does not interfere with the stopper portion 29R, and the shaft member 15 does not rotate. Accordingly, the relative phase between the plate member 13R and the shaft member 15 increases as the opening angle of the lid 5 increases.

More specifically, as shown in FIGS. 6(*b*), (*c*), and (*d*), as the lid 5 is opened at angles of 0°, 45°, and 90°, the shaft 19 (shaft restricting portion 23) of the damper 11R rotates, and the relative phase of the shaft 19 and the case 17 (case restricting portion 21) changes to substantially 10°, substantially 55°, and substantially 100°. The damper 11R does not generate any resistance caused by a twist in the opening direction of the lid 5, which is produced between the case 17 and the shaft 19.

FIG. 6(*a*) is a diagram showing a state where the lid 5 is positioned at −10°, and there is no twist of the shaft restricting portion 23 and the case restricting portion 21 of the damper 11R. At this time, the stopper screw 27 of the plate member 13R contacts the stopper portion 29, and the plate member 13 and the shaft member 15 thus do not relatively rotate in the opposite direction (in the direction in which the lid 5 is closed).

As shown in FIGS. 6(*e*) to (*i*), when the lid 5 is opened at an angle exceeding 90°, namely, 95°, 135°, 180°, 185°, and 190°, the stopper screw 27 of the plate member 13R contacts the stopper portion 29, causing the plate member 13R and the shaft member 15 to rotate together. Because the case 17 of the damper 11R rotates together with the shaft member 15, the relative phase of the case 17 of the damper 11R and the shaft 19 does not change from the state shown in FIG. 6(*d*).

FIGS. 7 (*a*), (*b*), (*c*), (*d*), (*e*), (*f*), (*g*), (*h*), and (*i*) are diagrams for explaining the movement of the damper 11L in FIG. 2.

Next, the movement of the damper 11L will be explained.

The rotation of the lid 5 is absorbed by the damper 11R from when the lid 5 is in a closed state (0°) to when it is opened at angles of 45° and 90°, and the shaft member 15 thus does not rotate. Accordingly, as shown in FIGS. 7(*b*), (*c*), and (*d*), the relative phase of the shaft restricting portion 23 of the damper 11L and the case restricting portion 21 remains constant at substantially 10°.

FIG. 7(*a*) is a diagram showing a state where the lid 5 is positioned at −10°.

As shown in FIGS. 7(*e*) to (*g*), when the lid 5 is opened at an angle exceeding 90°, namely, 95°, 135°, and 180°, the stopper screw 27 of the plate member 13L does not interfere with the stopper portion 29, and the shaft member 15 rotates. Accordingly, the relative phase between the plate member 13L and the shaft member 15 increases as the opening angle of the lid 5 increases.

Because the case 17 of the damper 11L is secured to the shaft member 15 and rotates together with the shaft member 15, the relative phase between the case 17 (case restricting portion 21) and the shaft 19 (shaft restricting portion 23) changes to substantially 15°, substantially 55°, and substantially 100°. Of the twist produced between the case 17 and the shaft 19, the damper 11L generates a resistance caused by the twist in the direction in which the lid 5 is opened.

As shown in FIGS. 7(*h*) and (*i*), when the lid 5 is opened at an angle exceeding 180°, namely, 185°, and 190°, the stopper screw 27 of the plate member 13L contacts the stopper portion 29.

In this way, as shown in FIGS. 7(*h*) and (*i*), when the lid 5 is opened at 190°, the stopper screw 27 of the plate member 13R, the shaft member 15, and the stopper screw 27 of the plate member 13L make contact. Accordingly, the lid 5 does not rotate further in the opening direction.

Next, the operation in a case where the lid 5 goes from an opened state to a closed state will be described.

Basically, the operations of the dampers 11R and 11L are the same as those in the case where the lid 5 is opened from a closed state, and a description thereof is thus omitted here. However, the direction of the relative rotation between the cases 17 and the shaft 19 of the dampers 11R and 11L is reversed; therefore, the timing at which the resistance is generated is changed.

More specifically, the relative phase between the shaft 19 of the damper 11L and the case 17 changes while the lid 5 is closed from 180° to 90°. The damper 11L does not generate resistance in this rotation direction. The relative phase between the shaft 19 of the damper 11R and the case 17 changes while the lid 5 is closed from 90° to 0°. The damper 11R generates resistance in this rotation direction.

Figure 8:
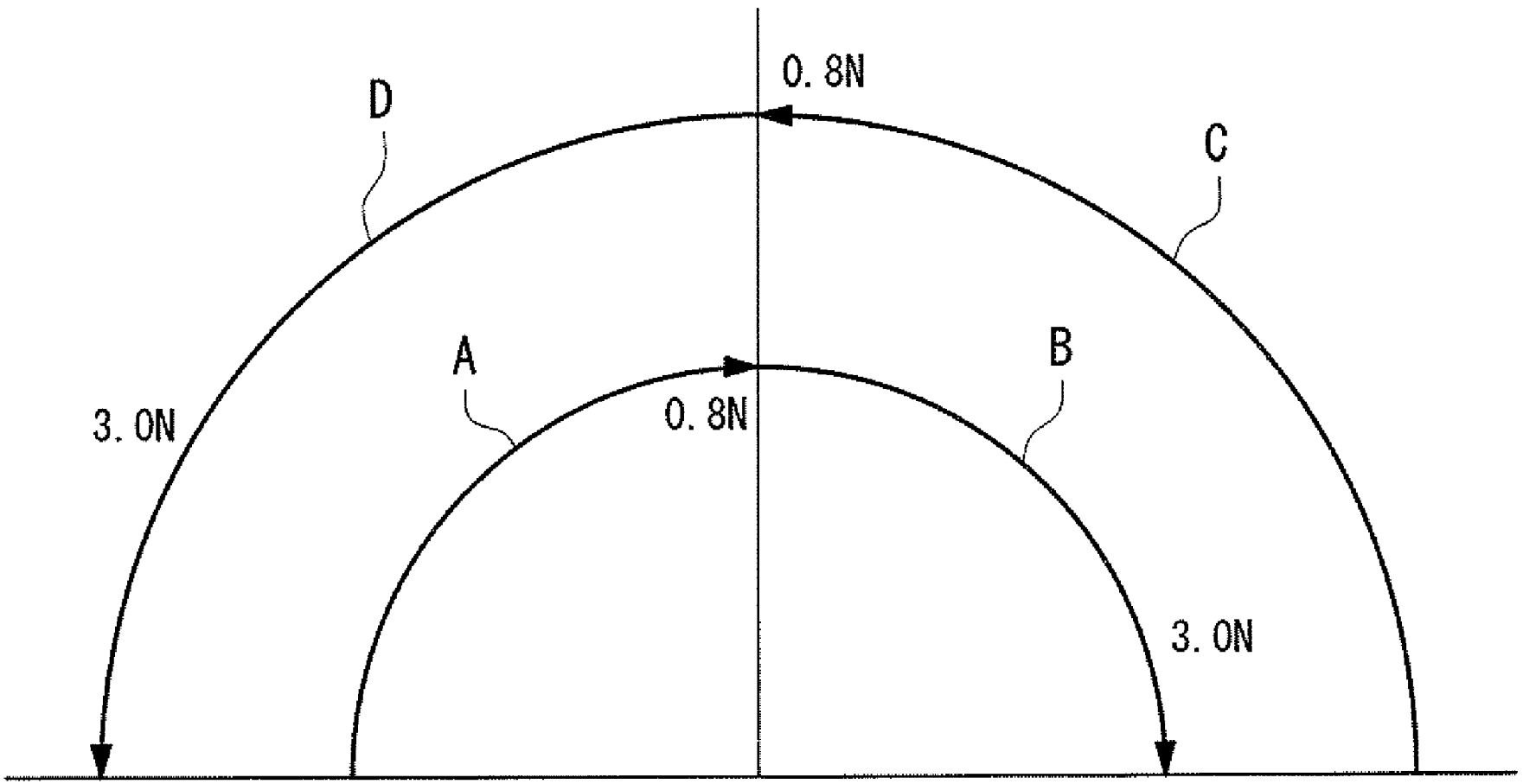
FIG. 8 is a diagram for explaining the relationship between resistance due to the damper and an opening angle of a lid portion in FIGS. 6 and 7.

FIG. 8 is a diagram for explaining the relationship between resistance due to the dampers and an opening angle of a lid portion in FIGS. 6 and 7.

The relationship between the resistance due to the dampers 11R and 11L and the opening angle of the lid 5 is as shown in FIG. 8. When the lid 5 is opened to substantially 90° from a closed state (A), the dampers 11R and 11L do not generate a resistance, and the lid 5 can be opened with a weak force (for example, a force of 0.8 N). When the lid 5 is opened to an angle exceeding substantially 90°, up to 180° (B), a resistance due to the damper 11L is generated, and a strong force (for example, a force of 3.0 N) is required to open the lid 5.

On the other hand, when the lid 5 is closed to substantially 90° from the opened state (C), a resistance due to the dampers 11R and 11L is not generated; therefore, the lid 5 can be closed with a weak force (for example, a force of 0.8 N). When the lid 5 is closed to 0°, passing substantially 90° (D), a resistance due to the damper 11R is generated, and a strong force (for example, a force of 3.0 N) is required to open the lid 5.

According to the above configuration, by providing the plate members 13R and 13L and the shaft member 15, the damper 11R can generate resistance only when the opening-and-closing angle of the lid 5 (specifically, opening-and-closing angle at a center of gravity of the lid 5 and the lid hinge 9) rotates in the closing direction from substantially 90°, and the damper 11L can generate resistance only when the opening-and-closing angle of the lid 5 rotates in the opening direction from substantially 90°.

In other words, the opening-and-closing mechanism 1 of this embodiment can always generate resistance using the damper 11R or the damper 11L when the lid 5 rotates in the direction away from the opening-and-closing angle of substantially 90°; therefore, the rotation force of the lid 5 can be reduced. On the other hand, when the lid 5 rotates in the direction toward the opening-and-closing angle of substantially 90°, the damper 11R and the damper 11L do not generate resistance; therefore, the lid 5 can be easily rotated.

In this embodiment, because the lid 5 is opened and closed from a substantially horizontal state, the center of gravity of the lid 5 and the lid hinge 9 is positioned on a perpendicular plane including the rotation axis C when the opening-and-closing angle is 90°. Accordingly, when the lid 5 rotates in the direction in which gravity acts, the resistance due to the damper 11R or the damper 11L is always generated, allowing a reduction of the rotational speed.

On the other hand, when the lid 5 is raised against the gravitational force, the damper 11R and the damper 11L do not generate resistances, thus allowing the lid 5 to be raised by a weak force.

Because the relative phase ranges between the lid hinge 9 and the shaft member 15, and between the container hinge 7 and the shaft member 15 are restricted by the stopper screws 27 and the stopper portions 29R and 29L, it is possible to prevent damage to the damper 11R and the damper 11L. In other words, by restricting the ranges which the relative phases between the lid hinge 9 and the shaft member 15, and between the container hinge 7 and the shaft member 15 can take to within the usable ranges of the damper 11R and the damper 11L, it is possible to prevent damage to the damper 11R and the damper 11L when using them outside the usable range.

The opening-and-closing mechanism 1 can be reduced in size by aligning the damper 11R and the damper 11L on the rotation axis C.

Because the damper 11R and 11L are connected in series by the joint 25, the operating ranges of the damper 11R and

11L are combined, thus allowing the operating ranges of the damper 11R and 11L to be increased.

The movement of the damper 11R and the damper 11L in the direction of the rotation axis C is restricted by the bush 33. In other words, because the loads in the direction of the rotation axis to be applied to the damper 11R and the damper 11L are supported by the bush 33, it is possible to prevent damage to the damper 11R and the damper 11L caused by the loads in the direction of the rotation axis C.

The technical scope of the present invention is not limited to the embodiments described above; various modifications can be applied so long as they do not depart from the spirit of the present invention.

For example, although the above embodiments have been described in terms of a configuration in which the opening-and-closing mechanism 1 is applied to a substantially horizontal opening of the container 3; the opening-and-closing mechanism can be applied to other types of containers, such as a container 3, etc. having an inclined opening.

In the above embodiment, the invention is applied to an opening-and-closing mechanism of a lid of a container of a refrigerated compartment or a container of analysis equipment, such as a DNA sequencer, an antibody detection device, and so forth. However, the invention is not limited to the opening-and-closing mechanism of the container described above. It may also be applied to an opening-and-closing mechanism of a rotating lid used for opening and closing a piano, a laptop computer, office equipment such as a copy machine, and the like.

The invention claimed is:

1. An opening-and-closing mechanism comprising:

two parallel and opposite supporting members with an intermediate member disposed between the two supporting members in a direction perpendicular to the parallel direction of the two supporting members, such that the two supporting members and the intermediate member are rotatable about a rotation axis, wherein the rotation axis is in a direction parallel to the intermediate member;

a first damper, disposed between a first one of the supporting members and the intermediate member, for generating resistance against rotation during a first portion of rotation of the two supporting members in a first direction;

a second damper, disposed between a second one of the supporting members and the intermediate member, for generating resistance against rotation during a second portion of rotation of the two supporting members in a second direction, wherein the second direction is opposite to the first direction and the first portion of rotation is different from the second portion of rotation; and rotation-restricting portions formed in a predetermined region at each end of the intermediate member for restricting rotation ranges of the first and second dampers, wherein the rotation-restricting portions are depressed regions in a direction perpendicular to the rotation axis.

2. An opening-and-closing mechanism according to claim 1, wherein at a rotation position of the two supporting members between said first portion of rotation and said second portion of rotation, the rotation ranges of the first and second dampers are positioned so that a center of gravity of a rotary member fixed to the first one of the supporting members is disposed within a vertical plane including the length of the rotation axis.

3. An opening-and-closing mechanism according to claim 1, wherein the first one of the supporting members includes a stopper screw which contacts one of the rotation-restricting portions during rotation of the first one of the supporting members so as to cause the intermediate member to rotate.

4. An opening-and-closing mechanism according to claim 1, wherein the first damper and the second damper are disposed in line on the rotation axis.

5. An opening-and-closing mechanism according to claim 4, further comprising:

a first restricting member between the first damper and the first one of the supporting members to restrict the movement of the first damper in the direction of the rotation axis towards the first one of the supporting members; and a second restricting member between the second damper and the second one of the supporting members to restrict the movement of the second damper in the direction of the rotation axis towards the second one of the supporting members.

* * * * *